US010823456B2

(12) United States Patent
Xu et al.

(10) Patent No.: US 10,823,456 B2
(45) Date of Patent: Nov. 3, 2020

(54) GAS WATER HEATING APPARATUS

(71) Applicant: A.O. SMITH (CHINA) WATER HEATER CO., LTD., Nanjing (CN)

(72) Inventors: Yijun Xu, Nanjing (CN); Ziwen Fu, Nanjing (CN); Maohu Cai, Nanjing (CN)

(73) Assignee: A.O. SMITH CORPORATION, Milwaukee, WI (US)

( * ) Notice: Subject to any disclaimer, the term of this patent is extended or adjusted under 35 U.S.C. 154(b) by 47 days.

(21) Appl. No.: 15/922,446

(22) Filed: Mar. 15, 2018

(65) Prior Publication Data

US 2018/0266727 A1 Sep. 20, 2018

(30) Foreign Application Priority Data

Mar. 17, 2017 (CN) ..... 2017 1 01600637

(51) Int. Cl.

| | |
|---|---|
| ***F24H 9/12*** | (2006.01) |
| ***F24H 9/00*** | (2006.01) |
| ***F24H 9/14*** | (2006.01) |
| *F24H 1/12* | (2006.01) |
| *F24H 9/18* | (2006.01) |

(52) U.S. Cl.

CPC ..... *F24H 9/126* (2013.01); *F24H 9/0015* (2013.01); *F24H 9/14* (2013.01); *F24H 1/124* (2013.01); *F24H 9/0005* (2013.01); *F24H 9/1836* (2013.01)

(58) Field of Classification Search

CPC ..... F24H 9/126; F24H 9/14; F24H 9/0015; F24H 9/128; F24H 9/148; F24H 9/001

USPC ..... 122/13.01

See application file for complete search history.

(56) References Cited

U.S. PATENT DOCUMENTS

| | | | | |
|---|---|---|---|---|
| 6,622,661 | B1 * | 9/2003 | Hotton | F23L 17/00 122/13.01 |
| 7,040,258 | B2 * | 5/2006 | Peart | F23M 9/02 122/13.01 |
| 2016/0282011 | A1 * | 9/2016 | Umakoshi | F24H 1/165 |

* cited by examiner

*Primary Examiner* — Steven B McAllister
*Assistant Examiner* — Benjamin W Johnson
(74) *Attorney, Agent, or Firm* — Michael Best & Friedrich LLP

(57) ABSTRACT

The present disclosure discloses a gas water heating apparatus comprising: a shell; a burner, a heat exchanger, and a fan which are disposed in sequence within the shell, wherein a combustion region is formed between the burner and the heat exchanger that are spaced from each other by a first preset distance; a first enclosing frame that encloses the combustion region, an air inlet portion being disposed on a side wall of the first enclosing frame; a heat insulating plate which is disposed within the first enclosing frame and is spaced from an inner surface of the side wall of the first enclosing frame by a second preset distance, wherein when the fan is in operation, air outside the first enclosing frame can flow into a region between the first enclosing frame and the heat insulating plate through the air inlet portion. The present disclosure provides a gas water heating apparatus having an optimized temperature reducing structure and capable of achieving a significant temperature reduction effect.

10 Claims, 8 Drawing Sheets

GAS WATER HEATING APPARATUS

CROSS REFERENCE TO RELATED APPLICATIONS

This disclosure claims the benefits of Chinese patent applications No. 2017101600637 filed on Mar. 17, 2017, which are incorporated herein by reference.

FIELD

The present disclosure relates to the field of gas appliances, and particularly, to a gas water heating apparatus.

BRIEF DESCRIPTION OF RELATED DEVELOPMENTS

The gas water heating apparatus is usually a gas appliance which transfers energy into cold water flowing through the heat exchanger by means of combustion heating by taking fuel as the fuel, for the purpose of preparing hot water. The specific forms include the wall hanging furnace, the gas water heater, etc.

The ordinary gas water heating apparatus mainly includes components such as a shell, a burner that combusts fuel gas to produce high temperature heat energy, a heat exchanger that circulates water to be heated, a fan, etc. In which, since high temperature heat energy is produced during the combustion, a high temperature region is formed in an upper space of the burner. In order to prevent the high temperature heat energy from being transferred into the shell and electronic components around the high temperature region, a combustion chamber is usually provided in a high temperature region around the burner, and corresponding temperature reducing structure is provided around the combustion chamber.

In which, one typical temperature reducing structure is constructed by providing a heat insulating material on an inner side of the combustion chamber. However, experiments and uses show that the effect of the heat insulating material is not merely decided by the material itself, and the thickness is an important factor which influences the heat insulation performance. The ideal heat insulation effect cannot be achieved if the thickness of the heat insulating material cannot reach a predetermined thickness; while if a heat insulation is performed with a heat insulating material reaching the predetermined thickness, the assembly is complex, and the whole machine is cumbersome.

Another typical temperature reducing structure is obtained by providing a water circulation line around the combustion chamber. Although the structure provided with the water circulation line can reduce the temperature of the combustion chamber at certain extent, its structure is complex and the cost is high.

In conclusion, it is necessary to further improve the existed gas water heating apparatus, and particularly, to optimize its temperature reducing structure.

SUMMARY

An objective of the present disclosure is to provide a gas water heating apparatus with an optimized temperature reducing structure.

The objective of the present disclosure can be achieved by the following technical solutions:

A gas water heating apparatus, comprising:

a shell;

a burner, a heat exchanger, and a fan which are disposed in sequence within the shell, wherein a combustion region is formed between the burner and the heat exchanger that are spaced from each other by a first preset distance;

a first enclosing frame that encloses the combustion region, an air inlet portion being disposed on a side wall of the first enclosing frame;

a heat insulating plate which is disposed within the first enclosing frame and is spaced from an inner surface of the side wall of the first enclosing frame by a second preset distance, wherein when the fan is in operation, air outside the first enclosing frame can flow into a region between the first enclosing frame and the heat insulating plate through the air inlet portion.

Further, the burner is at least partially disposed within the first enclosing frame, or the gas water heating apparatus further comprises a second enclosing frame connected to the first enclosing frame, and the burner is disposed within the second enclosing frame.

Further, the heat exchanger comprises a third enclosing frame, the first enclosing frame and the third enclosing frame being separately connected or integral.

Further, the heat insulating plate is provided with holes, through which the air entering the region between the heat insulating plate and the first enclosing frame through the air inlet portion can flow to the combustion region and/or the heat exchanger.

Further, there is a height difference between the holes and the air inlet portion.

Further, the heat insulating plate has a first end and a second end that are opposite to each other, wherein the first end is close to the heat exchanger and the second end is close to a combustion surface of the burner.

Further, the holes are close to the first end, and the air inlet portion is close to the second end.

Further, the air inlet portion disposed on the first enclosing frame is positioned above the combustion surface of the burner.

Further, the heat insulating plate is provided with a fixing portion, and the first enclosing frame is provided with a connection portion that matches the fixing portion.

Further, the heat insulating plate is provided at the second end thereof with a stopper, and the stopper is disposed between the inner surface of the side wall of the first enclosing frame and the heat insulating plate.

Further, the stopper is formed by bending the second end of the heat insulating plate towards the first enclosing frame.

Further, the holes include at least a first hole and a second hole, the first hole being disposed at the first end of the heat insulating plate and the second hole being disposed on the side wall of the heat insulating plate.

Further, the air inlet portion directly faces the heat insulating plate, so that the air entering through the air inlet portion can directly contact the heat insulating plate and flow upwards along a gap between the heat insulating plate and the first enclosing frame, wherein a part of the air flows out of the gap through the first hole, and the other part of the air flows out of the gap through the second hole.

As can be seen from the technical solutions according to the embodiments of the present disclosure, the heat insulating plate is disposed between the first enclosing frame and the combustion region, the air inlet portion is disposed on the side wall of the first enclosing frame, and a temperature reducing structure for cooling the first enclosing frame is formed by the heat insulating plate and the first enclosing frame disposed with the air inlet portion; when the fan is in operation, air outside the first enclosing frame can flow into a region between the first enclosing frame and the heat insulating plate through the air inlet portion to form an air-cooling channel, so as to cool the first enclosing frame and prevent its temperature from being too high. The gas water heating apparatus of the present disclosure is improved based on an exhausting-type structure, and the interior of the gas water heating apparatus is under a negative pressure state, so that at least the following advantages can be obtained when the first enclosing frame is provided with the air inlet portion to form the temperature reducing structure together with the heat insulating plate.

1. When the gas water heating apparatus is working, the internal pressure thereof is less than the ambient pressure, so that air outside the first enclosing frame can easily enter the region between the first enclosing frame and the heat insulating plate, which significantly enhances the temperature reduction effect.

2. The side wall is provided with the air inlet portion, so that a large amount of air enters at a small resistance, and the temperature reduction effect is remarkable.

3. The holes are disposed outside the combustion chamber, so that cold air can directly enter the region between the first enclosing frame and the heat insulating plate when the gas water heating apparatus is working, and the temperature reduction effect is significant.

REFERENCE SIGNS

Figure 1:
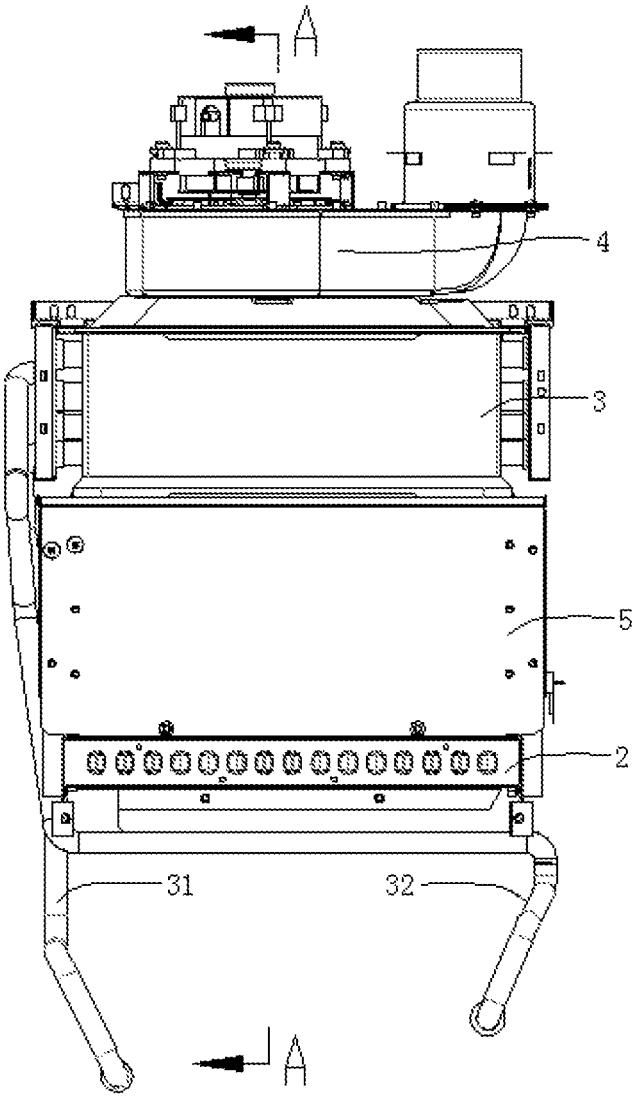
FIG. 1 is a schematic diagram showing an internal structure of a gas water heating apparatus according to an embodiment of the present disclosure.

2 burner;
3 heat exchanger;
31 water inlet pipe;
32 water outlet pipe;
4 fan;
5 first enclosing frame;
5A second enclosing frame;
5B third enclosing frame;
50 air inlet portion;
6 heat insulating plate;
61 second hole;
62 first hole;
63 stopper.

DETAILED DESCRIPTION

Next, the technical solutions of the present disclosure will be described in details with reference to the drawings and the specific embodiments. It should be appreciated that those embodiments are just employed to illustrate the present disclosure, rather than limit the scope thereof. Various equivalent amendments to the present disclosure made by a person skilled in the art after reading the present disclosure should fall within the scope defined by the accompanied claims of the present application.

To be noted, when an element is described as being "disposed/provided" on another element, it may be located on another element directly, or there may be an intermediate element. When an element is described as being "connected to" another element, it may be connected to another element directly, or there may be an intermediate element. The terms "vertical", "horizontal", "upper", "lower", "left", "right", and the like used herein are just for the purpose of description, rather than indicating a unique embodiment.

Unless otherwise defined, all of the technical and scientific terms used herein are the same as those commonly understood by a person skilled in the technical field of the present disclosure. The terms used in the specification of the present application are just for the purpose of illustrating the specific embodiments, rather than limiting the present disclosure. The term "and/or" used herein includes any and all combinations of one or more related items listed.

The present disclosure provides a gas water heating apparatus with an optimized temperature reducing structure, which can achieve a significant temperature reduction effect while optimizing the overall structure of the gas water heating apparatus.

In the prior art, the air supply modes of the gas water heating apparatus include a blowing type and an exhausting type, wherein in the gas water heating apparatus of the blowing type, a fan is generally mounted at a lower portion of the burner, and the fan, the burner and the heat exchanger are disposed in sequence from bottom to top. Since a positive pressure is generated in the combustion chamber of the gas water heating apparatus, any hole cannot be formed in the combustion chamber, otherwise the flame will dart through the hole to directly increase the temperatures of the elements around the combustion chamber and of the shell.

In the embodiment of the present disclosure, the air supply mode of the gas water heating apparatus is the exhausting type, for example, an upward exhausting mode. When the gas water heating apparatus employs the air supply mode of the exhausting type, a negative pressure is generated inside the gas water heating apparatus, including the combustion chamber, i.e., the internal pressure of the gas water heating apparatus is lower than the ambient pressure, so that the flame will not escape, and the use is reliable and safe.

Referring to FIGS. 1 to 6, a gas water heating apparatus according to an embodiment of the present disclosure may comprise: a shell (not illustrated); a burner 2, a heat exchanger 3, and a fan 4 which are disposed in sequence within the shell; wherein a combustion region is formed between the burner 2 and the heat exchanger 3 that are spaced from each other by a first preset distance; a first enclosing frame 5 that encloses outside the combustion region, an air inlet portion 50 being disposed on a side wall of the first enclosing frame 5; a heat insulating plate 6 which is disposed within the first enclosing frame 5 and is spaced from an inner surface of the side wall of the first enclosing frame 5 by a second preset distance; when the fan 4 is in operation, air outside the first enclosing frame 5 can flow into a region between the first enclosing frame 5 and the heat insulating plate 6 through the air inlet portion 50.

In this embodiment, the air supply mode employed by the gas water heating apparatus may be the upward exhausting type, and the burner 2, the heat exchanger 3, and the fan 4 are disposed in sequence from bottom to top. After the fan 4 is started, a negative pressure can be generated inside the shell, so as to suck ambient air into the shell, and also discharge the high temperature flue gas generated in the fuel gas combustion.

The shell is at the outermost layer of the gas water heating apparatus to house various parts of the gas water heating apparatus. The specific shape of the shell may be a hollow case, and of course may be other forms. For example, the shape, size, structure, etc. of the shell may vary depending on the actual use scene, which is not limited herein. In which, the shell may be provided with a first opening for air intake and a second opening for flue gas discharge. After the gas water heating apparatus is started, under the action of the fan 4, a negative pressure is generated inside the shell, and ambient air enters the shell through the first opening to be mixed with the fuel gas, so as to provide oxygen required for combustion; and the high-temperature flue gas produced in the subsequent combustion of the fuel gas is discharged through the second opening due to the suction of the fan 4.

The fan 4 is used for providing a driving force for a flow of an airstream. Specifically, the structure, position, and disposing manner of the fan 4 may vary depending on the actual use scene, which is not limited herein. When the gas water heating apparatus employs the upward exhausting type, the burner 2, the heat exchanger 3, and the fan 4 are disposed in sequence from bottom to top within the shell. At that time, a main airstream channel from the first opening to the second opening of the gas water heating apparatus is formed. Specifically, the main airstream channel may be a gas passage from the first opening of the shell to the burner 2, the heat exchanger 3, the fan 4, and the second opening.

The burner 2 is used for mixing the fuel gas with air for combustion. After an ignition, the high temperature flue gas generated by the mixed combustion of the fuel gas and air may be used to heat a water stream in the heat exchanger 3. Specifically, the structure and form of the burner 2 may vary depending on the actual use scene, which is not limited herein.

Water to be heated is circulated in the heat exchanger 3. One end of the heat exchanger 3 is communicated with a water inlet pipe 31, and the other end thereof is communicated with a water outlet pipe 32. Specifically, the shape and construction of the heat exchanger 3 are not limited herein.

The combustion region is formed between the burner 2 and the heat exchanger 3 that are spaced from each other by the first preset distance, and in the combustion region, the fuel gas and air are combusted to generate high temperature flue gas. When the burner 2 performs combustion, a plane where flame holes of a burner row are located is a combustion surface.

Correspondingly, the first preset distance between the burner 2 and the heat exchanger 3 may be set according to the position of the combustion region, so as to ensure that a high temperature combustion region formed when the burner 2 performs a combustion can at least cover the heat exchanger 3, thereby heating water passing through the heat exchanger 3.

The first enclosing frame 5 may be disposed outside the combustion region, and it may cover the combustion region or extend upwards or downwards, which is not limited herein. The shape of the first enclosing frame 5 may be a rectangular case with two ends opened. In addition, the shape and construction of the first enclosing frame 5 are not limited to the above example, and may be adaptively vary depending on the actual application scene.

The heat insulating plate 6 is disposed on an inner side of the first enclosing frame 5. The heat insulating plate 6, on one hand, insulates the high temperature heat of the combustion region from the first enclosing frame 5, and on the other hand, matches the first enclosing frame 5 to form a temperature reducing structure. Specifically, the heat insulating plate 6 may be a thin plate made of a high temperature resistant material, with a second preset distance from the first enclosing frame 5 so as to ensure a gap formed between the heat insulating plate 6 and the first enclosing frame 5; Specifically, the magnitude of the second preset distance is not limited herein.

The air inlet portion 50 may be disposed on the side wall of the first enclosing frame 5 to guide air entering the shell from the outside into the gap between the first enclosing frame 5 and the heat insulating plate 6, so as to blow heat, which is transferred into the gap through the heat insulating plate 6, out of the gap and causes the heat to flow to the heat exchanger 3. Thus, not only the temperature of the first enclosing frame 5 is reduced, but also the heat exchange efficiency of the gas water heating apparatus is improved.

When the fan 4 is in operation, air outside the first enclosing frame 5 can flow into a region between the first enclosing frame 5 and the heat insulating plate 6 through the air inlet portion 50, so as to form an air-cooling channel, thereby cooling the first enclosing frame 5 and preventing its temperature from being too high.

In the gas water heating apparatus according to the embodiments of the present disclosure, the heat insulating plate 6 is disposed at the inner side of the first enclosing frame 5 outside the combustion region, the air inlet portion 50 is disposed on a side wall of the first enclosing frame 5, and a temperature reducing structure for cooling the first enclosing frame 5 is formed by the heat insulating plate 6 and the first enclosing frame 5 provided with the air inlet portion 50; when the fan 4 is in operation, air outside the first enclosing frame 5 can flow into the region between the first enclosing frame 5 and the heat insulating plate 6 through the air inlet portion 50 to form an air-cooling channel, so as to cool the first enclosing frame 5 and prevent its temperature from being too high. The gas water heating apparatus of the present disclosure is improved based on an exhausting-type structure, and the interior of the gas water heating apparatus is under a negative pressure state, so that at least the following advantages can be obtained when the first enclosing frame 5 provided with the air inlet portion 50 and the heat insulating plate 6 form the temperature reducing structure:

1. When the gas water heating apparatus is working, the internal pressure thereof is less than the ambient pressure, so that air outside the first enclosing frame 5 can easily enter the region between the first enclosing frame 5 and the heat insulating plate 6, which achieves a better temperature reduction effect than the manner of performing a heat insulation merely with the heat insulating plate, or with the auxiliary temperature reduction by air flowing from the lower portion of the first enclosing frame.

2. In the case where the air inlet portion 50 is disposed on the side wall of the first enclosing frame 5, when the gas water heating apparatus is working, air can enter the region between the first enclosing frame 5 and the heat insulating plate 6 almost without any resistance, i.e., it can be ensured that there is stable air of a predetermined amount continuously entering the region between the first enclosing frame 5 and the heat insulating plate 6 for cooling, so as to achieve a significant temperature reduction effect.

Regarding the gas water heating apparatus provided with no air inlet portion, when it's working, air may also enter region between the first enclosing frame and the heat insulating plate from the lower portion of the first enclosing frame; nevertheless, due to the complex internal structure of the combustion chamber of the gas water heating apparatus, air coming from the lower portion of the first enclosing frame is disturbed by the internal structure in the flow process, and it cannot be ensured that there is stable air of a predetermined amount flowing into the region between the first enclosing frame and the heat insulating plate.

3. In the case where the air inlet portion 50 is disposed on the side wall of the first enclosing frame 5, when the gas water heating apparatus is working, cold air outside the first enclosing frame 5 can directly enter the region between the first enclosing frame 5 and the heat insulating plate 6, and the temperature reduction effect is significant.

Regarding the gas water heating apparatus provided with no air inlet portion, even if there is a certain amount of air entering the region between the first enclosing frame and the heat insulating plate, the air has been preheated in advance, and the temperature reduction effect is much weaker than that achieved by low temperature air entering the region between the first enclosing frame 5 and the heat insulating plate 6 from the outside of the first enclosing frame 5.

In addition, in relation to a gas water heating apparatus without the above temperature reducing structure, the gas water heating apparatus of the present disclosure has a largely lower requirement for the heat insulating plate 6, so that the thickness of the heat insulating plate 6 may be reduced, which is advantageous to optimize the overall structure of the gas water heating apparatus.

Figure 7:
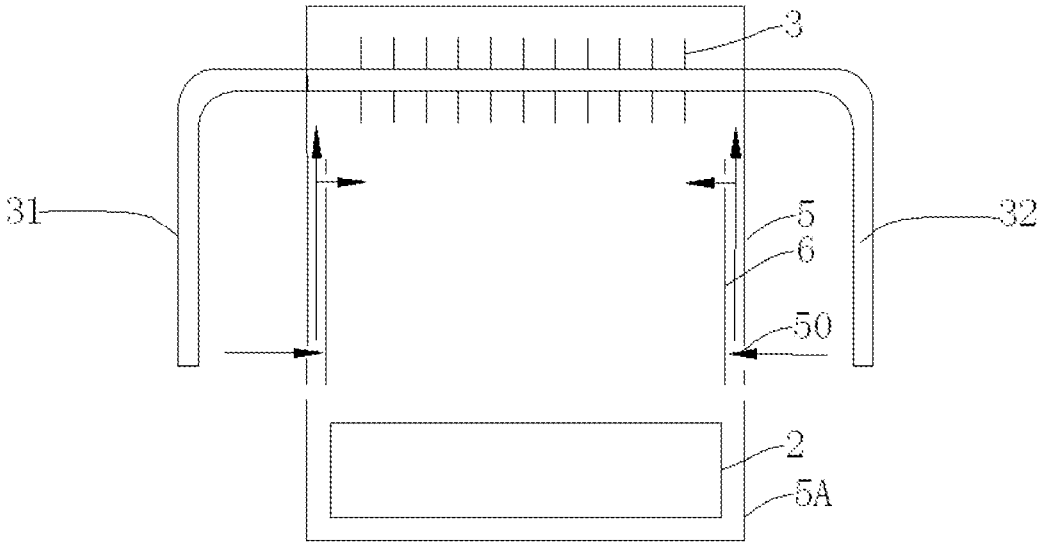
FIG. 7 is a schematic diagram showing an internal structure of a shell of the gas water heating apparatus according to the embodiment of the present disclosure.

Referring to FIG. 7, in one embodiment, the burner 2 is at least partially disposed within the first enclosing frame 5, or the gas water heating apparatus further comprises a second enclosing frame 5A connected to the first enclosing frame 5, and the burner 2 is disposed within the second enclosing frame 5A.

Figure 2:
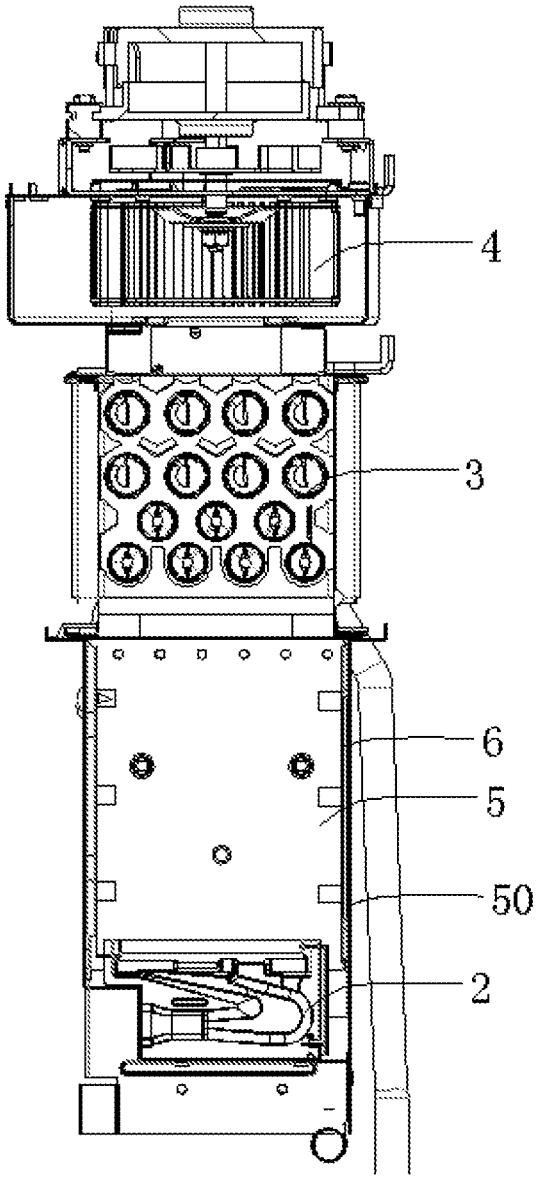
FIG. 2 is a cross-sectional view taken along A-A of FIG. 1, showing the gas water heating apparatus according to the embodiment of the present disclosure.
Figure 3:
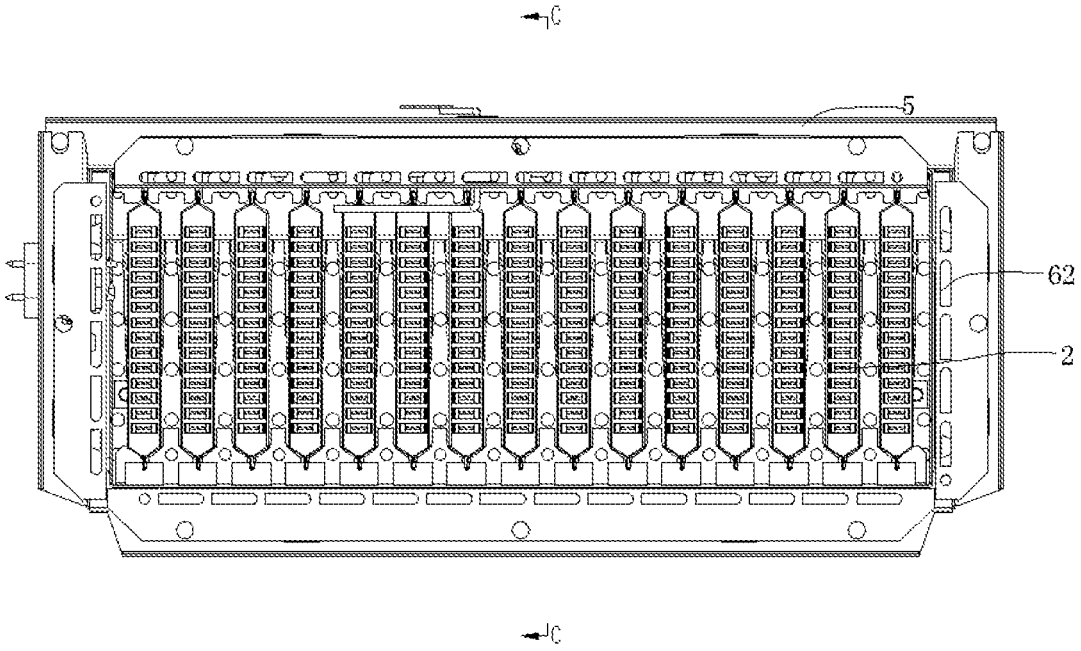
FIG. 3 is a top view showing a part of a gas water heating apparatus according to the embodiment of the present disclosure, below a heat exchanger.
Figure 4:
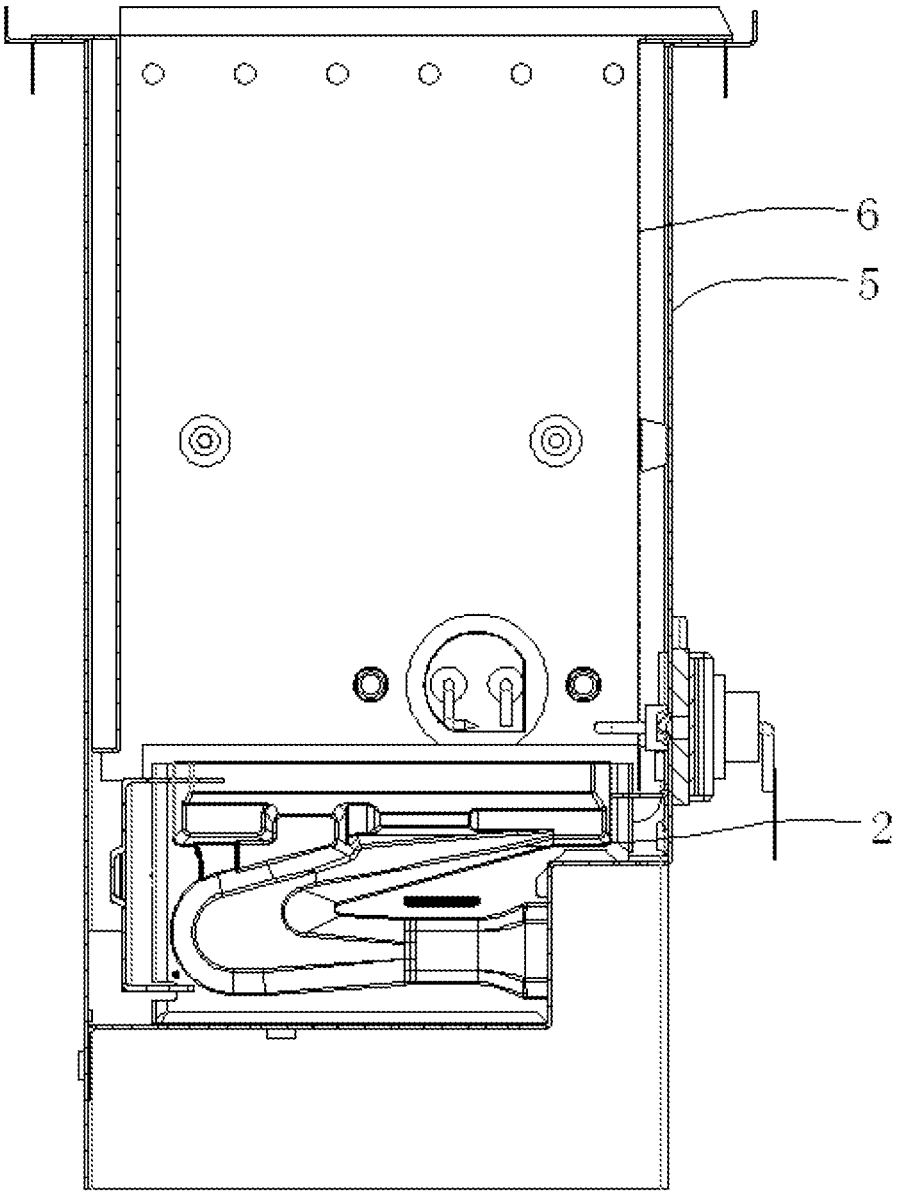
FIG. 4 is a cross-sectional view taken along C-C of FIG. 3, showing the gas water heating apparatus according to the embodiment of the present disclosure.
Figure 5:
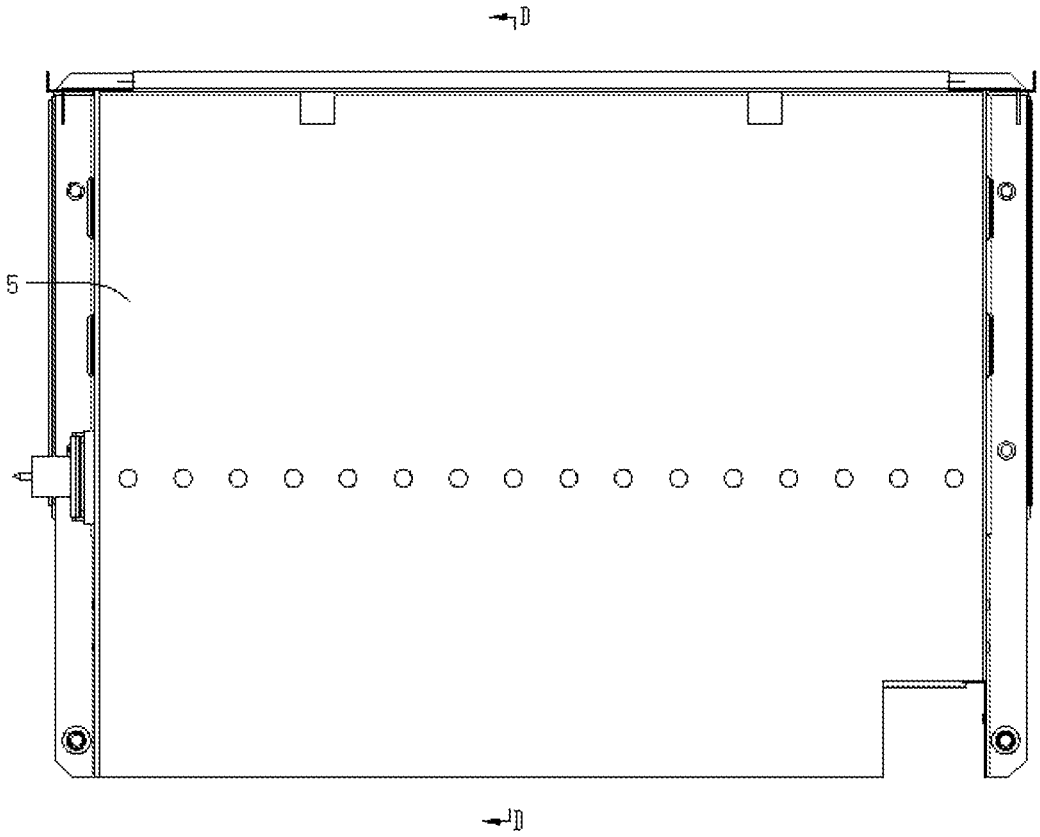
FIG. 5 is a schematic diagram showing a side of a first enclosing frame of the gas water heating apparatus according to the embodiment of the present disclosure.

Referring to FIG. 2, in this embodiment, the first enclosing frame 5 forms the combustion chamber. The burner 2 may be partially or wholly disposed in the first enclosing frame 5. Specifically, the burner 2 may comprise a burner body provided with a plurality of burner rows, and a frame for fixing the burner body. The first enclosing frame 5 may extend downwards to the position of the burner row, or formed integrally with the frame of the burner body.

In addition, as illustrated in FIG. 7, a separate second enclosing frame 5A which is disposed at the lower portion of the first enclosing frame 5 may be provided at the periphery of the burner 2. The first enclosing frame 5 and the second enclosing frame 5A connected to each other may form the combustion chamber. The first enclosing frame 5 and the second enclosing frame 5A may be fixedly connected to each other. Specifically, the fixed connection mode may include a fixed bolted connection, clamping, etc., which is not limited herein.

Figure 8:
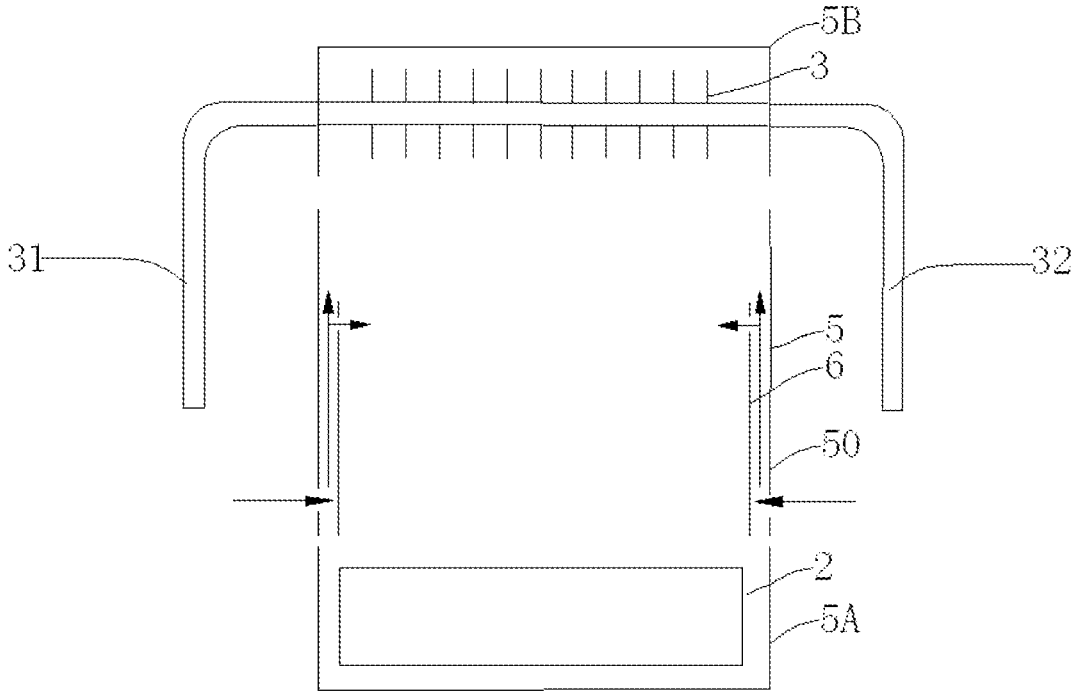
FIG. 8 is another schematic diagram showing the internal structure of the shell of the gas water heating apparatus according to the embodiment of the present disclosure.

Referring to FIG. 8, in another embodiment, the heat exchanger 3 comprises a third enclosing frame 5B, wherein the first enclosing frame 5 and the third enclosing frame 5B are separately connected or integral.

In this embodiment, the first enclosing frame 5 forms the combustion chamber. The third enclosing frame 5B is provided outside the heat exchanger 3, and may be integrally formed with the first enclosing frame 5 or separately connected to the first enclosing frame 5. When the third enclosing frame 5B is integrally formed with the first enclosing frame 5, it is equivalent to replacing the case of the heat exchange body with the upper portion of the first enclosing frame 5.

In addition, as illustrated in FIG. 8, a separate third enclosing frame 5B which is disposed at the upper portion of the first enclosing frame 5 may be provided at the periphery of the heat exchanger 3, and the first enclosing frame 5 and the third enclosing frame 5 B connected to each other may form a combustion chamber. The third enclosing frame 5B and the first enclosing frame 5 may be fixedly connected to each other. Specifically, the fixed connection mode may include a fixed bolted connection, clamping, etc., which is not limited herein.

Since in the gas water heating apparatus of the present disclosure, the first enclosing frame 5 provided with the air inlet portion 50 forms a temperature reducing structure together with the heat insulating plate 6, the third enclosing frame 5B or the first enclosing frame 5 no longer needs to be provided with a water circulation line, i.e., the whole temperature of the combustion chamber can be controlled within a reasonable range. As compared with the existing manner of reducing the temperature by disposing a water circulation pipeline, the present disclosure can reduce unnecessary piping structures, decrease the cost of the gas water heating apparatus, and lower the height of the gas water heating apparatus, which is favorable to the miniaturization of the whole structure of the gas water heating apparatus.

In one embodiment, the heat insulating plate 6 may be provided with holes, through which the air entering the region between the heat insulating plate 6 and the first enclosing frame 5 from the air inlet portion 50 can flow to the combustion region and/or the heat exchanger 3.

In this embodiment, the insulating plate 6 may be provided with holes for exporting air entering the region between the heat insulating plate 6 and the first enclosing frame 5 from the air inlet portion 50. Specifically, the holes may be those opened in the heat insulating plate 6 at predetermined height positions, or one whole elongated hole, etc., which is not limited herein. In which, air flowing out of the holes can flow to at least one of the combustion region and the heat exchanger 3.

For example, the holes are located within a height range of the combustion region, and when they are directly facing the first enclosing frame 5, air entering the region between the heat insulating plate 6 and the first enclosing frame 5 from the air inlet portion 50 can enter the combustion region through the holes, thus achieving an effect of combustion-supporting;

meanwhile, air entering the region between the heat insulating plate 6 and the first enclosing frame 5 from the air inlet portion 50 can flow to the heat exchanger 3 through the holes; since the air absorbs heat transferred through the heat insulating plate 6, the heat is then absorbed by the heat exchanger, thereby improving the efficiency of the gas water heating apparatus.

When the heat exchanger 3 is located at the upper portion of the first enclosing frame 5, while the holes are provided at the upper portion of the first enclosing frame 5 to directly face the heat exchanger 3, air entering the region between the heat insulating plate 6 and the first enclosing frame 5 from the air inlet portion 50 can enter the combustion region through the holes while flowing to the heat exchanger 3; the air entering through the holes supports the combustion on one hand, and transfers heat to the heat exchanger 3 on the other hand.

In order to ensure that air entering the region between the heat insulating plate 6 and the first enclosing frame 5 from the air inlet portion 50 can achieve an ideal temperature reduction effect for the first enclosing frame 5, while air flowing from the holes to the combustion region and/or the heat exchanger 3 has a high temperature, the positions of the holes have height differences with the position of the air inlet portion 50.

In one specific embodiment, the heat insulating plate 6 has a first end and a second end that are opposite to each other, wherein the first end is close to the heat exchanger 3 and the second end is close to the combustion surface of the burner 2.

In this embodiment, the heat insulating plate 6 has a first end and a second end that are opposite to each other. Regarding the gas water heating apparatus employing the upward exhausting type, the first end is relatively upper, which is a top of the heat insulating plate 6 and located to be close to the heat exchanger 3; the second end is relatively lower, which is a bottom of the heat insulating plate 6 and located to be close to the combustion surface of the fuel gas. In which, when the burner 2 performs a combustion, a plane where flame holes of a burner row are located is the combustion surface.

Specifically, the holes may be close to the first end, and the air inlet portion 50 may be close to the second end. When the holes are close to the first end and the air inlet portion 50 is close to the second end, the distance between the holes and the air inlet portion 50 can be increased, which enables air entering the region between the heat insulating plate 6 and the first enclosing frame 5 from the air inlet portion 50 to have a long journey, so that an ideal temperature reduction effect can be achieved for the first enclosing frame 5, while the air flowing from the holes to the combustion region and/or the heat exchanger 3 has a high temperature.

Further, the air inlet portion 50 on the first enclosing frame 5 may be above the combustion surface of the burner 2.

In this embodiment, since the high temperature region is above the combustion surface, the air inlet portion 50 may be disposed above the combustion surface. Specifically, the air inlet portion 50 may be flush with or higher than the combustion surface, which is not limited herein, provided that air entering the region between the heat insulating plate 6 and the first enclosing frame 5 through the air inlet portion 50 is below the start position of the high temperature region, so as to ensure that cold air entering from air inlet portion 50 can sufficiently exchange heat with the heat insulating plate 6.

In one embodiment, the heat insulating plate 6 is provided with a fixing portion, and the first enclosing frame 5 is provided with a connection portion matched with the fixing portion.

In this embodiment, the heat insulating plate 6 may be provided with a fixing portion for mounting and location; accordingly, the first enclosing frame 5 may be provided with a connecting portion matched with the fixing portion, can be arranged on the first frame 5 to achieve the mounting and location of the heat insulating plate 6.

Specifically, the fixing portion may be a locating hole formed on the heat insulating plate 6, and the connecting portion may be a projection matched with the locating hole, wherein when the projection is engaged in the locating hole, the mounting and location of the heat insulating plate 6 can be achieved. In addition, the connecting portion may be in the form of a locating hole, and the fixing portion may be in the form of a projection; or both the connecting portion and the fixing portion may be in the form of a locating hole, and they are fixed by locating bolts. Of course, other constructions and disposing manners of the fixing portion and the connecting portion may be possible, and a person skilled in the art can also make other changes under the inspiration of the technical essence of the present disclosure, provided that the realized functions or achieved effects are the same as or similar to those of the present disclosure, and those changes shall fall within the protection scope of the present disclosure.

In one embodiment, the second end of the heat insulating plate 6 is provided with a stopper 63 which is disposed between the inner surface of the side wall of the first enclosing frame 5 and the heat insulating plate 6 to block the gap between the second end of the heat insulating plate 6 and the first enclosing frame 5, so as to prevent the air entering the region between the heat insulating plate 6 and the first enclosing frame 5 from flowing out below the second end of the heat insulating plate 6 (i.e., to ensure that air entering through the air inlet portion 50 can be used for cooling to achieve a better temperature reduction effect), and prevent any flame from entering the region between the heat insulating plate 6 and the first enclosing frame 5 through the gap between the second end of the heat insulating plate 6 and the first enclosing frame 5, then heating the first enclosing frame 5, and even escaping from the air inlet portion 50 of the first enclosing frame 5.

In one specific embodiment, the stopper 63 may be formed by bending the second end of the heat insulating plate 6 towards the first enclosing frame 5.

In this embodiment, the material of the heat insulating plate 6 may be a high temperature resistant material. Specifically, the heat insulating plate 6 may be made of stainless steel and the like; of course, the heat insulating plate 6 may also be made of other high temperature resistant material, which is not limited herein.

When the stopper 63 is formed by bending the second end of the heat insulating plate 6 towards the first enclosing frame 5, the stopper 63 can be clamped on the inner side of the first enclosing frame 5 by means of an interference fit; on one hand, since the bending process is well-known, the production cost can be reduced and the mounting is convenient; on the other hand, when the formation is made by bending the heat insulation plate 6, it is equivalent that the heat insulating plate 6 and the stopper 63 are integrally formed, so that there is no gap between the stopper 63 and the heat insulating plate 6, which is advantageous to ensure the blocking effect of the stopper 63.

Figure 6:
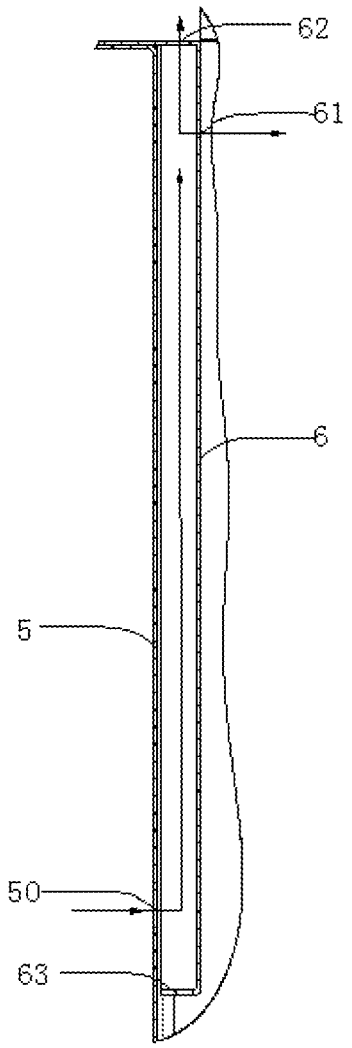
FIG. 6 is a cross-sectional view taken along D-D of FIG. 5, showing the first enclosing frame of the gas water heating apparatus according to the embodiment of the present disclosure.

Referring to FIG. 6, in one embodiment, the holes may include at least a first hole 62 and a second hole 61, wherein the first hole 62 is provided at the first end of the heat insulating plate 6 and the second hole 61 is provided on the side wall of the heat insulating plate 6.

In this embodiment, the first hole 61 and the second hole 62 provided on the heat insulating plate 6 export the air entering the region between the heat insulating plate 6 and the first enclosing frame 5 through the air inlet portion 50.

The heat insulating plate 6 has a first end and a second end that are opposite to each other, wherein the first end is higher than the second end. The first end is formed with an end portion capable of providing the first hole 62. Specifically, the end portion formed at the first end may be a flange formed outwards on the heat insulating plate 6; accordingly, the first hole 62 is provided on the flange. Specifically, at least one hole may be provided on the flange, wherein the shape and number of the first hole is not limited herein. In addition, the first hole 62 may also be provided on the side wall of the heat insulating plate 6 close to the first end and higher than the second hole 61, which is not limited herein.

The second hole 61 is lower than the first hole 62, and may be provided on the side wall of the heat insulating plate 6. Specifically, the second hole 61 may be at least one hole formed at the same horizontal height, wherein the shape and number thereof is not limited herein.

In one specific embodiment, the air inlet portion 50 directly faces the heat insulating plate 6, the air entering from the air inlet portion 50 can directly contact the heat insulating plate 6 and flow upwards along the gap between the heat insulating plate 6 and the first enclosing frame 5, wherein a part of the air flows out of the gap through the first hole 62, and the other part of the air flows out of the gap through the second hole 61.

In this embodiment, the air inlet portion 50 on the first enclosing frame 5 may directly face the heat insulating plate 6, so that air entering the region between the heat insulating plate 6 and the first enclosing frame 5 from the air inlet portion 50 of the first enclosing frame 5 can contact the heat insulating plate 6 immediately, and flow upwards along the heat insulating plate 6 to exchange heat with the heat insulating plate 6 sufficiently and efficiently, so as to cool the heat insulating plate 6 effectively. After entering the region between the heat insulating plate 6 and the first enclosing frame 5 through the air inlet portion 50, the air flows upwards to reach the holes on the heat insulating plate, where a part of the air flows out of the gap through the first hole 62, and the other part of the air flows out of the gap through the second hole 61. In which, since the second hole 61 is provided on the side wall of the heat insulating plate 6, the air flowing out of the second hole 61 can intersect the main airstream channel after entering the combustion region, so that the flue gas is mixed with the preheated air to achieve an efficient combustion-supporting.

Each of the above embodiment of the description is described in a progressive manner, the same or similar parts of those embodiments can refer to each other, and each of those embodiments lays an emphasis on its difference from other embodiments.

Those embodiments described above are just several embodiments of the present disclosure, and the above embodiments are only disclosed so as to facilitate the understanding of the present disclosure, rather than limit the present disclosure. A person skilled in the art can make any amendment or changes to the forms and details of the embodiments without deviating from the spirit and scope revealed by the present disclosure, while the patent protection scope of the present disclosure is still defined by the accompanied claims.

The invention claimed is:

1. A gas water heating apparatus comprising:

a shell;

a burner, a heat exchanger, and a fan which are disposed in sequence within the shell, wherein a combustion region is formed between the burner and the heat exchanger which are spaced from each other by a first preset distance;

a first enclosing frame that encloses the combustion region, an air inlet portion disposed on a side wall of the first enclosing frame; and a heat insulating plate which is disposed within the first enclosing frame and is spaced from an inner surface of the side wall of the first enclosing frame by a second preset distance, wherein when the fan is in operation, air outside the first enclosing frame flows under the influence of the fan into a gap between the first enclosing frame and the heat insulating plate through the air inlet portion, so as to blow heat, which is transferred into the gap through the heat insulating plate, out of the gap, wherein the heat insulating plate is provided with holes, through which the air entering the gap from the air inlet portion can flow to the combustion region and/or the heat exchanger;

wherein there is a height difference between each of the holes and the air inlet portion; and wherein the heat insulating plate has a first end and a second end that are opposite to each other, wherein the first end is closer to the heat exchanger than the second end and the second end is closer to a combustion surface of the burner than the first end.

2. The gas water heating apparatus according to claim 1, wherein the burner is at least partially disposed within the first enclosing frame, or the gas water heating apparatus further comprises a second enclosing frame connected to the first enclosing frame, and the burner is disposed within the second enclosing frame.

3. The gas water heating apparatus according to claim 1, wherein the heat exchanger comprises a third enclosing frame, the first enclosing frame and the third enclosing frame being separately connected or integral.

4. The gas water heating apparatus according to claim 1, wherein the holes are closer to the first end than the second end, and the air inlet portion is closer to the second end than the first end.

5. The gas water heating apparatus according to claim 1, wherein the air inlet portion disposed on the first enclosing frame is positioned above the combustion surface of the burner.

6. The gas water heating apparatus according to claim 1, wherein the heat insulating plate is provided with a fixing portion, and the first enclosing frame is provided with a connection portion; wherein the connection portion and the fixing portion are connected to position the heat insulating plate within the first enclosing frame spaced from the inner surface of the side wall of the first enclosing frame by the second preset distance.

7. The gas water heating apparatus according to claim 1, wherein the heat insulating plate is provided at the second end thereof with a stopper, and the stopper is disposed between the inner surface of the side wall of the first enclosing frame and the heat insulating plate.

8. The gas water heating apparatus according to claim 7, wherein the stopper is formed by bending the second end of the heat insulating plate towards the first enclosing frame.

9. The gas water heating apparatus according to claim 1, wherein the holes include at least a first hole and a second hole, the first hole being disposed at the first end of the heat insulating plate and the second hole being disposed on a side wall of the heat insulating plate.

10. The gas water heating apparatus according to claim 9, wherein the air inlet portion directly faces the heat insulating plate, so that the air entering through the air inlet portion can directly contact the heat insulating plate and flow upwards along the gap, and wherein a part of the air flows out of the gap through the first hole, and another part of the air flows out of the gap through the second hole.

* * * * *